US005621418A

United States Patent [19]

Maloney

[11] Patent Number: 5,621,418

[45] Date of Patent: Apr. 15, 1997

[54] FM-VERY HIGH FREQUENCY METAL DETECTOR

[76] Inventor: Daniel P. Maloney, Rt. 1 Box 313G, 1163 120 St., Roberts, Wis. 54023

[21] Appl. No.: 450,413

[22] Filed: May 25, 1995

[51] Int. Cl.[6] ..... H01Q 1/16

[52] U.S. Cl. ..... 343/742; 343/741

[58] Field of Search ..... 343/741, 742, 343/744, 743, 879, 890, 891

[56] References Cited

U.S. PATENT DOCUMENTS 3,573,832 4/1971 Callaghan ..... 343/742
3,993,998 11/1976 Kimmett ..... 343/744
4,397,041 8/1983 Takeda et al. ..... 343/742 X
4,495,706 1/1985 Kaminski ..... 343/894 X
4,595,928 6/1986 Wingard ..... 343/742

*Primary Examiner*—Donald T. Hajec
*Assistant Examiner*—Tho Phan

[57] ABSTRACT

A modified loop and nondirectional antenna system and receiver used in conjunction with a magnetic compass and 2 level vials for a point direction used to detect underground parasitic antennas or reflectors by supression and reception of receiver. The detector is directed at very deep propagated radio waves, several hundred feet deep or less.

2 Claims, 2 Drawing Sheets

FM-VERY HIGH FREQUENCY METAL DETECTOR

BACKGROUND OF THE INVENTION

This invention relates generally to underground or buried objects, and pertains more particularly to objects like metal tanks, barrels, cables and pipes capable of behaving as a parasitic antenna or reflector, since it intercepts and reradiates some of the energy radiated towards it.

Most detection instruments for underground objects are not adequate to penetrate and detect deep into the earth. Deep detectors in most cases must be connected to a source, which is also connected to the buried object. Often there is no "other" connection source; as for example, a tank without any protrusions, other than the tank itself. The result is that locating an object becomes a long process of searching, digging and locating or not finding the object at all. In some cases, a detector and transmitter are used by two individuals. This invention generally relates to the propagated radio waves which penetrate into the earth several hundred feet and less.

Hence, a need for an extremely efficient, uncomplicated, deep penetrating instrument detection continues to exist.

SUMMARY OF THE INVENTION

Accordingly, an important object of the present invention is to provide an efficient uncomplicated, deep penetrating instrument. In this regard, my invention requires no connecting to the object to be located or mounting of the FM Transmitter, since it intercepts from the desired direction, (the object) or parasitic antenna or reflector by suppressing signals and noise from other directions.

Briefly, my invention involves what will be called a modified radio compass having a modified loop antenna and a full curve antenna both interconnected, but open ends, and a nondirectional antenna. The modified loop and full curve antenna are connected to the end of the antenna on the (very sensitive)-FM receiver; and the nondirectional full circle antenna is connected at the closest point to the FM receiver antenna connection. The AM reception cannot be used. The tuning is done by holding the entire instrument vertical and moving it in a 360° circle, and concluding a setting of the closest FM stations where 3 to 4 stations will be picked up; 2 at 60°–120°; a 90° angle preferred.

The instrument is constructed of a minimal conducting material; wood and plastic with the magnetic compass raised above the main antenna so as not to interfere by magnetic activity or human body conduction.

The instrument location device is then search-passed over a underground tank, barrel, pipe or cable, etc. and the object by parasitic antenna or reflector will cause a station change or cessation of reception by suppression and reception. The ends of a tank, may be located further by moving from the middle of the tank, facing north ex., east to west with a cessation or station change of reception. Identification of a tank may be had for example by noting of 3 changes in stations or cessations. 1 on the first edge, 1 in the middle, and 1 at the other edge. An underground cable will cause 1 change as the foregoing. The red tuning indicator light may also be used in conjunction with the speaker or earphones.

The invention also comprises the novel combinations of a magnetic compass raised out of the antenna area on plastic and 2 level vials to maintain the instrument at approximately level. The magnetic compass giving point direction in conjunction with the two level vials. Changes in directions from the foregoing can give false readings. Electromagnetic disturbances, (high tension lines) etc., may cause false readings because of the homing device.

Briefly, my invention contemplates a system that is responsive to propagated radio waves which reach several hundred feet into the earth or less, depending on the dielectrics, frequencies and conductivities of the earth, etc.. The spirit of the invention is to be responsive to these deep, propagated radio waves.

DESCRIPTION OF THE PREFERRED EMBODIMENT

Figure 1:
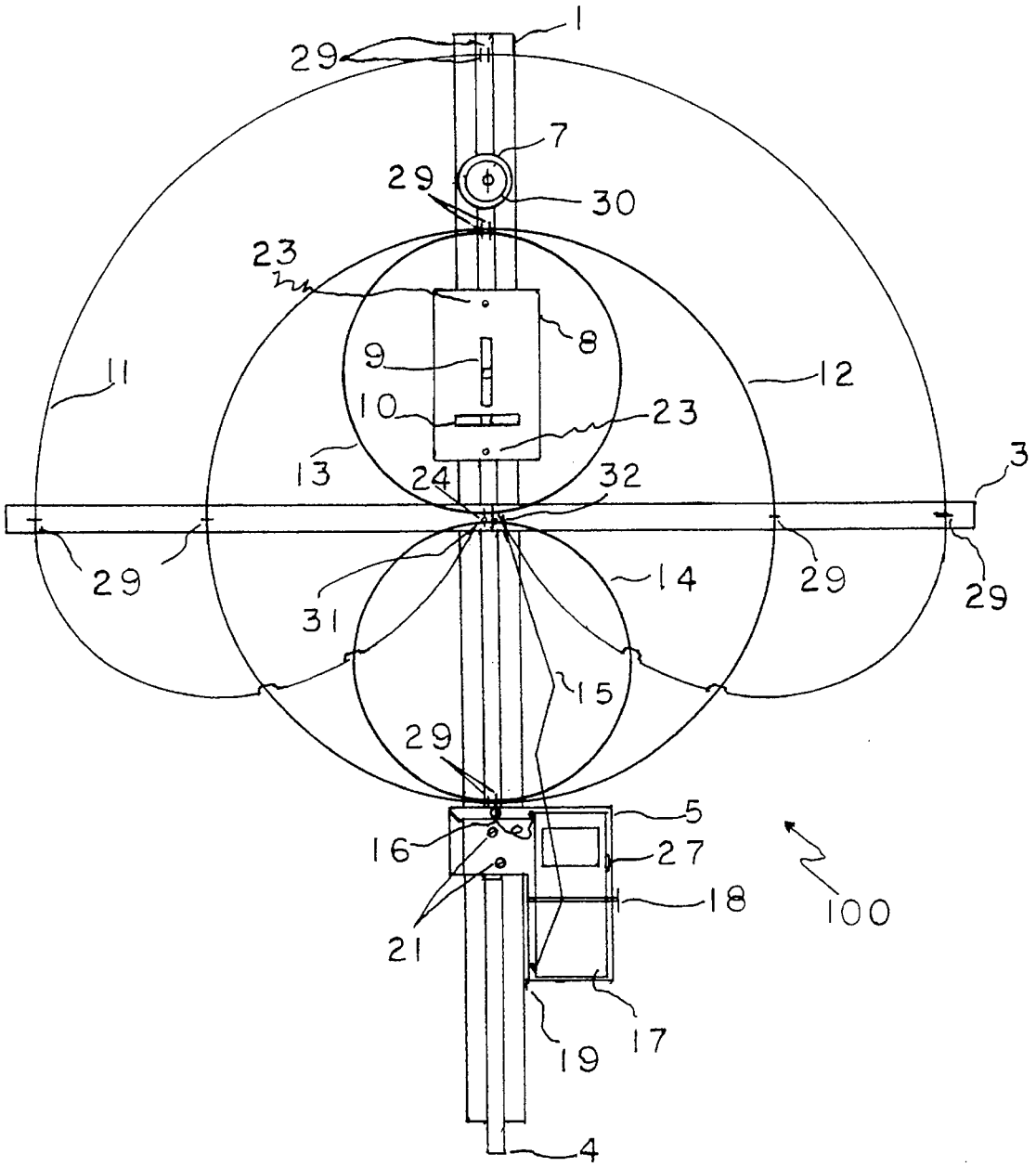
FIG. 1 is a top plan view showing essential features of my invention.

Considering first the embodiment of FIG. 1, the system has been denoted generally by the reference numeral 100. The system 100 is constructed of minimal conduction material; the main member 1, cross member support 3 and handle 4 are constructed of wood, (pine). Latex paint is used on these components as well as on components of the magnetic compass 30, being the sleeve 7 and support 6 depicted in FIG. 2.

Figure 2:
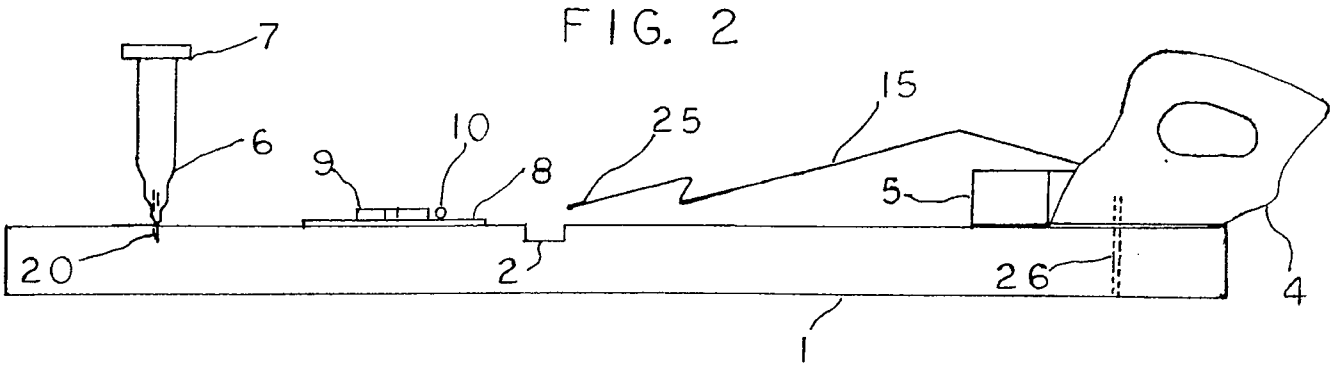
FIG. 2 is a left elevational view showing compass and antenna connection features.

The magnetic compass 30 is raised 4⅝ inches above the main member 1 on a rigid plastic support 6, FIG. 2, with a 1¼ inch metal peg 20, FIG. 2, in the main member 1.

The two level vials 9 and 10, are mounted by silcon adhesive on a wood plate 8, that is 3/16 of an inch thick. The wood plate 8 is mounted by 2 half inch brass screws 23 to the main member 1.

The modified loop 13 and 14 have a ⅜ inch of space between them, and the full curve antenna 11 are both connected at 31 and 32. The connections 31 and 32 are twisted together tightly to avoid a conflicting resistance. The antenna 13, 14, and 11 are constructed of number 12 insulated copper wire. The FM antenna connecter 25 is depicted in FIG. 2. The connecter 25 is on the end of a insulated strand copper wire 15 and crosses over the lower loop 14, not touching the insulated part of the lower loop 14. The copper wire of upper loop 13 and full curve 11 also extends about ½ inch over the lower loop 14 to enter connecter 25. Again the copper wires of 15 and 11 and 13 are put together to avoid any conflicting resistance.

The full circle nondirectional antenna 12 fits tight on the outer part of the modified loop 13 and 14 and is inserted at twist point into the front of the plastic radio support 5 and insulated copper strand wire 16, about 3 inches long is twisted tight on antenna 12 at this point.

Figure 3:
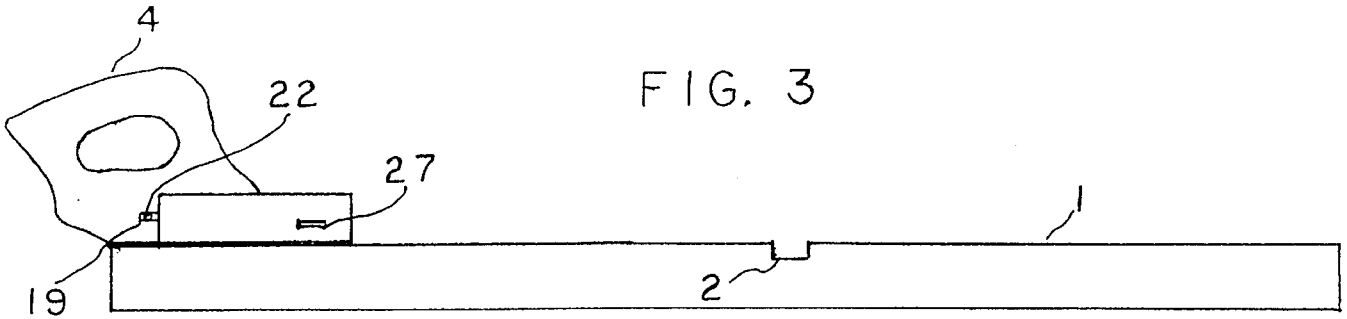
FIG. 3 is a right elevational view showing mounting features and tuning slot in receiver support.

The radio support 5 is mounted by 2 screws 21, about ½ inch long. The side hook, 19 is mounted by a screw 22, depicted in FIG. 3, into the main member 1. Elastic and a velcro hook 18 hold the receiver 17 in place.

The outer, further end of the receiver antenna left bottom of 17 is connected to strand wire 15 by tight twisting to avoid the foregoing mentioned resistance. The copper strand wire 15, see FIG. 2, must avoid intrusion on the system 100 and be kept above system 100.

The inner, upper left part of receiver 17 antenna is connected to copper strand wire 16 by insertion or twisting tightly. The size of the very sensitive FM receiver used is 2⅞ in. W×4¾ in. L×1 3/16 in. D. The receiver support has a tuning slot 27, FIG. 3.

Figure 4:
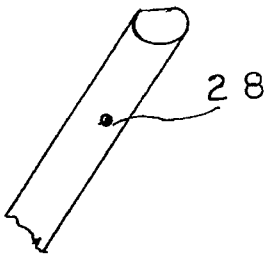
FIG. 4 is a partial bottom plan and rear elevational view showing position of screw for the handle.

When mounting the insulated number 12 copper wire antennas 11, 12, 13, and 14, ⅜ inch staples 29 are inserted to maintain position and should not break insulation on the wires. The handle 4 is mounted by a screw 28, FIG. 4 through main member 1 by insertion 26.

Figure 5:
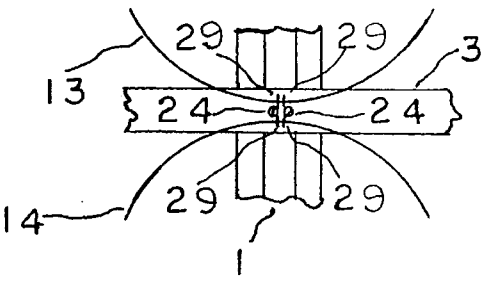
FIG. 5 is a partial top plan view showing cross member support with two screws for mounting and staples on upper and lower loop.

The cross member support 3 is mounted in a notched in area, FIG. 2 and the screws 24 are depicted in FIG. 5. The center staples 29 are depicted in FIG. 5 also.

I claim:

1. A FM underground metal detection antenna system using propagated radio waves, capable of detecting metal several hundred feet into the ground, comprising:

a wood main frame;

attached 28" W×25" L modified circular antenna loops;

a full circle nondirectional antenna and a full curve antenna;

said modified loops being separated by ⅜ inch of space between them, and said full circle nondirectional antenna fitting tightly on the outer parts of said modified loops;

said full curve antenna fitting above and on top of said modified loops and on top of said full circle antenna at crossover points;

said modified loops and said full curve antenna being connected to a first end of a sensitive FM receiver antenna via a first copper strand wire; and said full circle nondirectional antenna being connected to a second end of said sensitive FM receiver antenna via a second copper strand wire.

2. The antenna system of claim 1 including a wooden mount with two level vials; and a magnetic compass raised above said antenna system to maintain a point direction, not azimuth, while attempting to locate metal objects.

* * * * *